US008777033B2

(12) United States Patent
Korpanty et al.

(10) Patent No.: US 8,777,033 B2
(45) Date of Patent: Jul. 15, 2014

(54) PLASTIC CONTAINER WITH REINFORCED BASE AND CLOSURE AND SYSTEM AND METHOD OF MAKING SAME

(75) Inventors: Lawrence Korpanty, York, PA (US); Kevin D. Himes, Mount Wolf, PA (US); John E. Denner, York, PA (US); David B. Clements, Medina, OH (US); Robert D. Stoolmaker, York, PA (US); Thomas J. Atkinson, Phoenix, MD (US)

(73) Assignee: Graham Packaging Company, L.P., York, PA (US)

( * ) Notice: Subject to any disclaimer, the term of this patent is extended or adjusted under 35 U.S.C. 154(b) by 592 days.

(21) Appl. No.: 12/916,207

(22) Filed: Oct. 29, 2010

(65) Prior Publication Data

US 2012/0102880 A1 May 3, 2012

(51) Int. Cl.
*B65D 90/12* (2006.01)

(52) U.S. Cl.
USPC ..... 215/376

(58) Field of Classification Search
USPC ..... 215/376, 377, 373
See application file for complete search history.

(56) References Cited

U.S. PATENT DOCUMENTS

| | | | |
|---|---|---|---|
| 2,207,210 | A | 7/1940 | Von Knauf |
| 2,487,400 | A | 11/1949 | Tupper |
| 2,756,793 | A | 7/1956 | Tupper |
| 2,789,607 | A | 4/1957 | Tupper |
| 2,789,608 | A | 4/1957 | Tupper |
| 2,880,859 | A | 4/1959 | Tupper |
| 2,885,103 | A | 5/1959 | Cunningham, Jr. |
| 2,885,108 | A | 5/1959 | Donoghue |
| 2,892,540 | A | 6/1959 | Tupper |
| 2,901,098 | A | 8/1959 | Tupper |
| 2,941,660 | A | 6/1960 | Tupper |
| 3,044,610 | A | 7/1962 | Tupper |
| 3,744,671 | A | 7/1973 | Saunders, Jr. |
| 3,817,420 | A | 6/1974 | Heisler |
| 3,817,428 | A | 6/1974 | Buckley |

(Continued)

FOREIGN PATENT DOCUMENTS

| | | |
|---|---|---|
| WO | WO 00/27725 | 5/2000 |
| WO | WO 2004/046013 | 6/2004 |

OTHER PUBLICATIONS

International Application No. PCTUS2007023377—ISR and WO dated Jun. 5, 2008.
U.S. Appl. No. 11/979,730—Non-Final OA dated Mar. 9, 2010.

(Continued)

*Primary Examiner* — Mickey Yu
*Assistant Examiner* — Allan Stevens
(74) *Attorney, Agent, or Firm* — Baker Botts L.L.P.

(57) ABSTRACT

A plastic container and closure, and system and method of making the same. Container can include a solid bottom end, an outer sidewall extending from solid bottom end, a shoulder portion extending from outer sidewall, and neck portion extending from shoulder portion, forming an open end of container. Solid bottom end includes a circumferential heel portion having a plurality of radially asymmetrical projections and recesses disposed on an outer periphery of the heel portion, the plurality being configured to increase heel portion rigidity while maintaining substantially uniform material thickness. Shoulder portion forms an angle with a plane perpendicular to the container central axis. At an angle of 50° a desirable failure mode may be achieved where the yield strength of the shoulder portion is balanced against that of the heel portion and the outer sidewall to maximize the top load strength of the container.

14 Claims, 7 Drawing Sheets

(56) References Cited

U.S. PATENT DOCUMENTS

| | | | | |
|---|---|---|---|---|
| 3,913,785 | A | 10/1975 | Pattershall | |
| 4,201,311 | A | 5/1980 | Underwood | |
| 4,458,252 | A | 7/1984 | Kikuchi et al. | |
| 4,471,880 | A | 9/1984 | Taylor et al. | |
| 4,619,373 | A | 10/1986 | Galer | |
| 4,718,571 | A | 1/1988 | Bordner | |
| 4,928,846 | A | 5/1990 | Murrin, Jr. | |
| 4,933,133 | A | 6/1990 | Brown et al. | |
| 5,425,467 | A | 6/1995 | Feer et al. | |
| 5,458,252 | A | 10/1995 | Logel | |
| 5,460,287 | A | 10/1995 | Cargile et al. | |
| 5,505,326 | A | 4/1996 | Junko | |
| 5,927,499 | A * | 7/1999 | Vesborg | 206/509 |
| 6,269,962 | B1 * | 8/2001 | Anderson et al. | 215/398 |
| 6,412,661 | B1 | 7/2002 | Hannah, Sr. | |
| 6,530,500 | B2 | 3/2003 | Rowles et al. | |
| 6,619,498 | B2 | 9/2003 | von Holdt, Jr. | |
| 6,843,389 | B2 | 1/2005 | Kasting et al. | |
| 6,854,617 | B2 | 2/2005 | Taylor et al. | |
| 6,929,145 | B2 | 8/2005 | Shepler | |
| 6,959,829 | B2 | 11/2005 | Crider et al. | |
| 6,983,862 | B2 | 1/2006 | Nottingham et al. | |
| 7,036,693 | B2 | 5/2006 | Walsh et al. | |
| 7,040,509 | B2 | 5/2006 | McLelland et al. | |
| 7,066,345 | B2 * | 6/2006 | Itokawa et al. | 215/375 |
| 7,074,443 | B2 | 7/2006 | Thomas et al. | |
| 7,086,551 | B2 | 8/2006 | von Holdt, Jr. | |
| 7,090,088 | B2 | 8/2006 | von Holdt, Jr. | |
| 7,108,149 | B2 | 9/2006 | Taylor et al. | |
| 7,156,265 | B2 | 1/2007 | Walsh et al. | |
| 7,169,418 | B2 | 1/2007 | Dalton et al. | |
| 7,175,051 | B2 | 2/2007 | McLelland et al. | |
| 7,216,779 | B2 | 5/2007 | Kasting et al. | |
| 7,225,945 | B2 | 6/2007 | Crider et al. | |
| 7,325,968 | B2 | 2/2008 | Huckby et al. | |
| 7,434,706 | B2 | 10/2008 | Nottingham et al. | |
| 7,481,325 | B2 * | 1/2009 | Simpson et al. | 215/384 |
| 7,520,410 | B2 | 4/2009 | Gilbertson et al. | |
| 7,748,553 | B2 * | 7/2010 | Akiyama et al. | 215/382 |
| 2006/0163252 | A1 | 7/2006 | Zalewski | |
| 2006/0231985 | A1 | 10/2006 | Kelley | |
| 2007/0187413 | A1 | 8/2007 | Gruskin et al. | |
| 2008/0128380 | A1 * | 6/2008 | Denner et al. | 215/44 |

OTHER PUBLICATIONS

U.S. Appl. No. 11/979,730—Non-Final OA dated Sep. 30, 2010.

U.S. Appl. No. 11/979,730—Requirement for Restriction dated Oct. 1, 2009.

* cited by examiner

PLASTIC CONTAINER WITH REINFORCED BASE AND CLOSURE AND SYSTEM AND METHOD OF MAKING SAME

The present invention relates generally to the field of packaging bulk products such as paints, chemicals, or foods. More specifically, this invention relates to a plastic container and closure and system and method of making the same.

Containers for packaging bulk products are typically palletized for transport and storage. Each pallet may contain an array of containers, where the containers are stacked in multiple layers. As a result of the containers being stacked on top of each other, a vertical top load is applied to each container. The vertical top load on a container in a given layer increases in proportion with the number of layers stacked above the given layer. Additionally, pallets holding container arrays may be stacked in multiple layers. Such containers may also be transported and stored under extreme temperature conditions and may be subjected to prolonged periods of storage.

Many bulk product containers have been manufactured using steel or other metal-based compositions, to ensure the containers will maintain structural integrity under the previously described transport and storage conditions. As an alternative material to metal, plastic may offer relative ease of manufacturing, lighter container weight, and cost savings on raw material. Accordingly, a plastic container that maintains structural integrity under the previously described transport and storage conditions may be desirable.

In an exemplary embodiment of the present invention, a plastic container and closure combination includes a reinforced base having a heel geometry that increases heel stiffness. The shoulder of the container is formed at an angle to distribute the vertical top load proportionally between the shoulder, the sidewall, and the reinforced base. These features may increase the ability of the container to support higher vertical top loads and maintain its structural integrity during container closure and stacking operations, as well as under the previously described transport and storage conditions.

In an exemplary embodiment of the present invention, a plastic container and closure combination may include a container having a solid bottom end; an outer sidewall extending from the solid bottom end; a shoulder portion extending from the outer sidewall; and a neck portion extending from the shoulder portion to create an open end of the container, the neck portion having a diameter less than a diameter of the outer sidewall; and a closure having: a sealing portion including an outer portion and an inner portion, the outer portion having a diameter greater than the diameter of the neck portion of the container and the inner portion having a diameter less than the diameter of the neck portion of the container; a spring portion extending inward from the sealing portion; and a flexible planar center area in the center of the closure and extending inward from the spring portion; where the solid bottom end includes a circumferential heel portion having a plurality of radially asymmetrical projections and recesses disposed on an outer periphery of the heel portion, the plurality of projections and recesses being configured to increase rigidity of the heel portion while maintaining substantially uniform material thickness; where the container defines a container central axis, and the shoulder portion forms a shoulder angle with a plane perpendicular to the container central axis; and where the shoulder angle is selected to balance a strength of the shoulder portion against a strength of the heel portion and a strength of the outer sidewall to maximize a top load strength of the container, and the selected shoulder angle is in the range of 30 to 75 degrees. The solid bottom end may include at least one support surface for supporting the container and closure on a horizontal surface, and the projections and recesses may be disposed radially outwardly from the support surface. The selected shoulder angle may be 50 degrees. The closure may include a tab portion formed on it, the tab portion being configured to allow a force to be applied thereto to remove the closure from the container. The container may also include a handle.

In an exemplary embodiment of the present invention, a method of making a plastic container and closure combination for withstanding axial loading in stacking and closure operations may include: forming the container by forcing a gas into the container via an aperture in the container, the formed container having: a solid bottom end; an outer sidewall extending from the solid bottom end; a shoulder portion extending from the outer sidewall; and a neck portion extending from the shoulder portion to create an open end of the container, the neck portion having a diameter less than a diameter of the outer sidewall; and forming the closure, the closure having: a sealing portion including an outer portion and an inner portion, the outer portion having a diameter greater than the diameter of the neck portion of the container and the inner portion having a diameter less than the diameter of the neck portion of the container; a spring portion extending inward from the sealing portion; and a flexible planar center area in the center of the closure and extending inward from the spring portion; where the solid bottom end includes a circumferential heel portion having a plurality of radially asymmetrical projections and recesses disposed on an outer periphery of the heel portion, the plurality of projections and recesses being configured to increase rigidity of the heel portion while maintaining substantially uniform material thickness. The method may also include: filling the container with a bulk material; and securing the closure to the filled container, over the open end of the container. The method may also include: providing a plurality container and closure combinations, the container and closure combinations being similarly formed, filled, and secured; stacking the plurality of container and closure combinations to form an array of container and closure combinations, the array having at least two layers of stacked container and closure combinations; and securing the array of stacked container and closure combinations to one or more pallets. The bulk material with which the container is filled may be paint, for example. The plurality of projections and recesses may also be configured to facilitate removal of the container from a mold in a blow molding operation. The container may define a container central axis, and the shoulder portion may form a shoulder angle with a plane perpendicular to the container central axis; the shoulder angle may be selected to balance a strength of the shoulder portion against a strength of the heel portion and a strength of the outer sidewall to maximize a top load strength of the container; and the selected shoulder angle may be in the range of 30 to 75 degrees.

In an exemplary embodiment of the present invention, a system for making a plastic container and closure combination for withstanding axial loading in stacking and closure operations, may include: means for forming the container by forcing a gas into the container via an aperture in the container, the formed container having: a solid bottom end; an outer sidewall extending from the solid bottom end; a shoulder portion extending from the outer sidewall; and a neck portion extending from the shoulder portion to create an open end of the container, the neck portion having a diameter less than a diameter of the outer sidewall; and means for forming the closure, the closure having: a sealing portion including an outer portion and an inner portion, the outer portion having a diameter greater than the diameter of the neck portion of the container and the inner portion having a diameter less than the diameter of the neck portion of the container; a spring portion extending inward from the sealing portion; and a flexible planar center area in the center of the closure and extending inward from the spring portion; where the solid bottom end includes a circumferential heel portion having a plurality of radially asymmetrical projections and recesses disposed on an outer periphery of the heel portion, the plurality of projections and recesses being configured to increase rigidity of the heel portion while maintaining substantially uniform material thickness. The system may also include: means for filling the container with a bulk material; and means for securing the closure to the filled container, over the open end of the container. The bulk material with which the container is filled may be paint, for example. The sealing portion of the closure may be configured to be secured to the neck portion of the container, such that when the closure is secured to the container, the outer portion of the closure is located on the outside of the neck portion and the inner portion of the closure is located on the inside of the neck portion. The closure may also include means for removing the closure from the container.

BRIEF DESCRIPTION OF THE DRAWINGS

The accompanying drawings are incorporated in and constitute a part of the specification.

DETAILED DESCRIPTION

While the exemplary embodiments illustrated herein may show the various features of the present invention, it will be understood that the features disclosed herein may be combined variously to achieve the objectives of the present invention.

Figure 1:
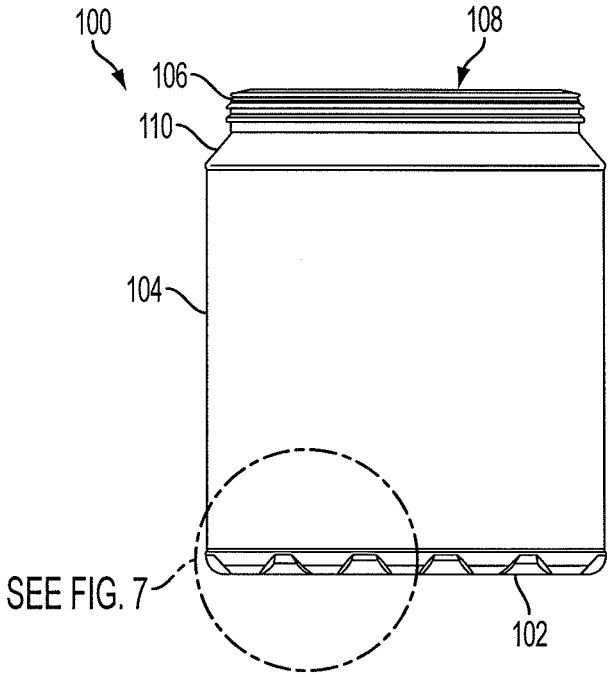
FIG. 1 is a front view of a container according to various embodiments of the present invention.

Turning to FIG. 1, container [100] is shown according to various embodiments. Container [100] can comprise any suitable material. For example, container [100] can comprise one or more plastics or combinations thereof, the plastics including, but not limited to, polyethylene terephthalate (PET), low density polyethylene (LDPE), high density polyethylene (HDPE), and nylons, as well as other polyesters, polyolefins, and polycarboxyamides having suitable properties for the intended application. Container [100] can be made by any suitable process or method, including, but not limited to blow molding, injection molding, and extrusion blow molding. U.S. Pat. No. 4,933,133 provides an example of a method of manufacture.

Figure 2:
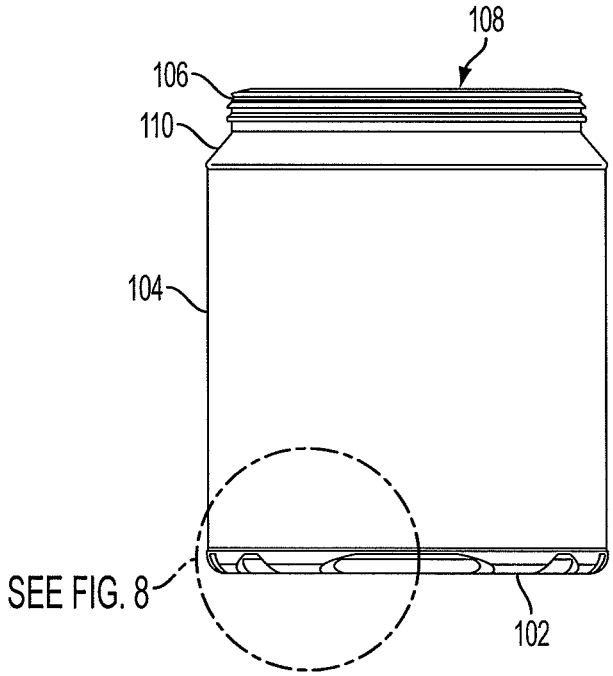
FIG. 2 is a side view of a container according to various embodiments of the present invention.
Figure 3:
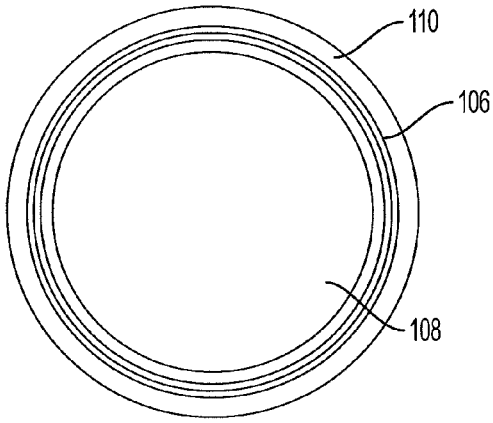
FIG. 3 is a top view of a container according to various embodiments of the present invention.

As shown in FIGS. 1 and 2, an embodiment of container [100] includes a solid bottom end [102], an outer sidewall [104], a shoulder portion [110], and a neck portion [106] that forms an open end [108] of container [100]. Outer sidewall [104] extends from solid bottom end [102], shoulder portion [110] extends from outer sidewall [104], and neck portion [106] extends from shoulder portion [110]. As can be seen in FIGS. 1-3, neck portion [106] can have a diameter that is less than a diameter of outer sidewall [104]. Additionally, outer sidewall [104] may have constant outer and inner diameters throughout its length. Container [100] forms a container central axis (not shown) that is substantially parallel to outer sidewall [104] and passes through the geometric center of container [100].

Figure 4:
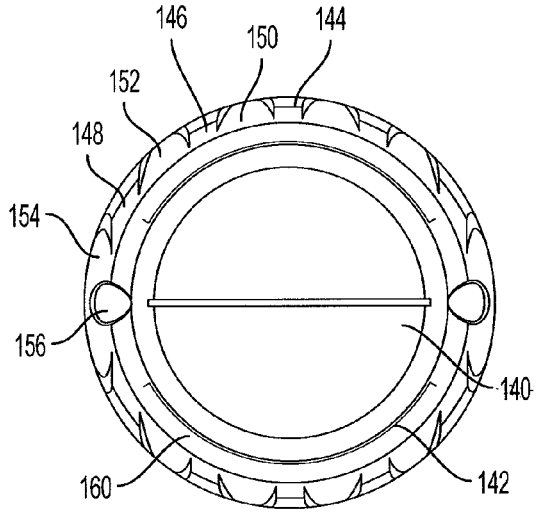
FIG. 4 is a bottom view of a container according to various embodiments of the present invention.
Figure 7:
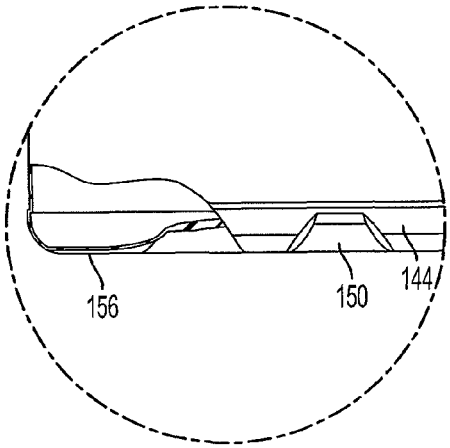
FIG. 7 is a fragmentary cross-sectional view depicting an enlarged portion of an area shown in FIG. 1.
Figure 8:
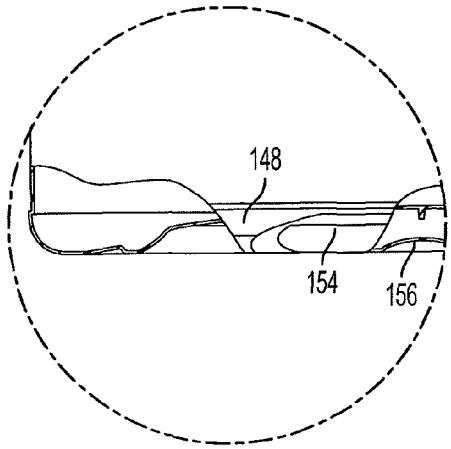
FIG. 8 is a fragmentary cross-sectional view depicting an enlarged portion of an area shown in FIG. 2.
Figure 9:
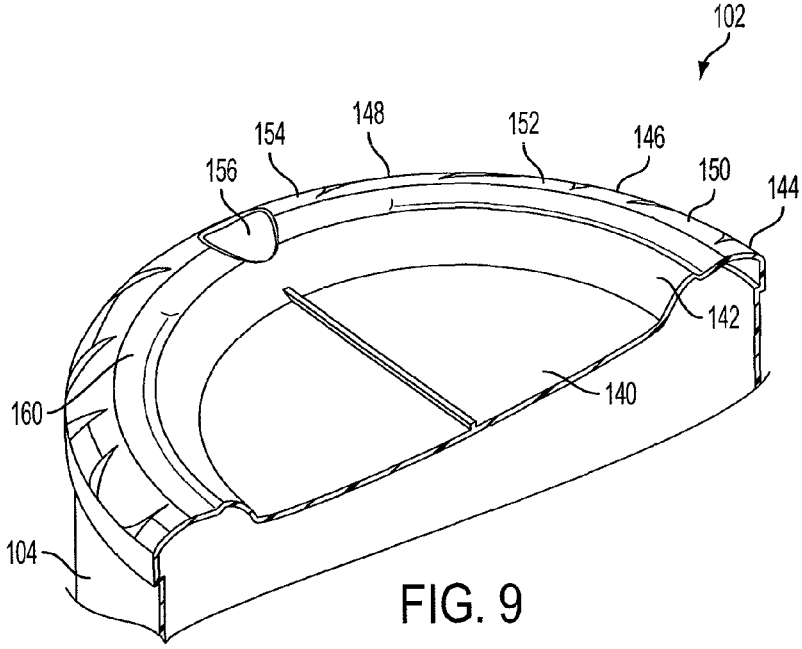
FIG. 9 is a fragmentary cross-sectional perspective view of a bottom portion of a container according to various embodiments of the present invention.

FIG. 4 shows a bottom view of container [100]. Solid bottom end [102] includes a planar center portion [140] and a support surface [160] located on the outer periphery of planar center portion [140] for supporting the container and closure on a horizontal surface. Ridges [142] are located between the outer periphery of planar center portion [140] and the inner periphery of support surface [160]. Indentations [156] are located on the outer periphery of planar center portion [140], at either axial end of a fin that runs across and protrudes from planar center portion [140]. Solid bottom end [102] also includes projections [144, 146, 148] and recesses [150, 152, 154] arranged circumferentially on the outer periphery of the heel portion and radially outward from support surface [160], forming a geometry that is similar in appearance to a truck tire. Each projection [144, 146, 148] has a bearing surface for supporting the container and closure on a horizontal surface, and side surfaces that taper away from the bearing surface and form part of a recess [150, 152, 154] located on either side of the projection. As is shown in FIGS. 7-9, projections [144, 146, 148] and recesses [150, 152, 154] of the heel portion are curved to conform generally to the profile of the heel portion, and run from support surface [160] along the outer periphery of the heel portion to the bottom of outer sidewall [104]. As can also be seen from FIGS. 4 and 7-9, projections [144, 146, 148] and recesses [150, 152, 154] are radially asymmetrical. Note, for example, that projection [146] extends circumferentially along the outer periphery of the heel portion to a greater degree than does projection [144], and projection [148] extends circumferentially along the outer periphery of the heel portion to a greater degree than does projection [146]. A similar geometric relationship exists among recesses [150, 152, 154].

The staggered projections [144, 146, 148] with intermittent recesses [150, 152, 154] effectively form two concentric load bearing rings or container bases, one having a relatively smaller radius than the other. The projections [144, 146, 148] and recesses [150, 152, 154] of the "truck tire" geometry generally increase the rigidity of the heel portion of solid bottom end [102] without having to increase material thickness in that portion of the container, and may increase the vertical top load container [100] will withstand before its heel portion rolls or experiences a buckling failure, thus improving container stability when securing a closure to the container and/or in a stacking formation such as the previously described array of containers. The projections [144, 146, 148] and recesses [150, 152, 154] of the "truck tire" geometry may also facilitate removal of container [100] from a mold in blow molding operations.

Figure 5:
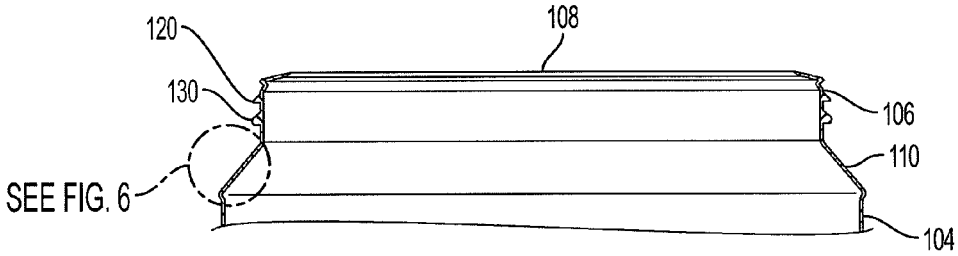
FIG. 5 is a fragmentary cross-sectional view of a container according to various embodiments of the present invention.

FIG. 5 shows a cross-sectional view of a portion of container [100] near open end [108]. Neck portion [106] may include one or more sealing ridges [120, 130] formed on the outer diameter thereof. The one or more sealing ridges [120, 130] can be any suitable sealing ridge of any suitable size and shape, including, but not limited to, threads, sealing beads, locking ridges, etc. As shown in FIG. 5, sealing ridge [120] may be of a different size and shape than sealing ridge [130]. Further, one or more sealing ridges [120, 130] can be positioned at any suitable position on the outer diameter of neck portion [106]. For example, in various embodiments, sealing ridge [120, 130] is annular and can extend completely around the outer periphery of neck portion [106]. Container [100] may have a uniform wall thickness, as shown in FIG. 5.

In various embodiments, container [100] can include a handle. The handle can be any suitable size or shape and can be configured on container [100] at any suitable position and orientation. Moreover, the handle can be made of any suitable material, including, but not limited to, plastic, metal, etc. In various embodiments, the handle can be attached to an outside part of neck portion [106]. In various embodiments, the handle may be formed separately from the container and can be coupled to the container after the container is formed. In another embodiment, the handle may be formed in one piece with the container. For example, the handle can be blow molded in one piece simultaneously with container [100].

Figure 6:
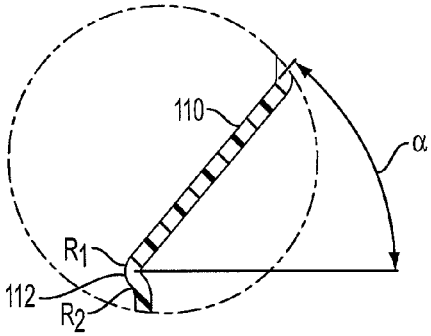
FIG. 6 is a fragmentary cross-sectional view depicting an enlarged portion of an area that is shown in FIG. 5.

FIG. 6 shows a cross-sectional view of a portion of container [100] near shoulder portion [110]. Shoulder portion [110] extends from the upper end of outer sidewall [104] e.g., the end of outer sidewall [104] nearest open end [108]. More specifically, shoulder portion [110] meets the upper end of outer sidewall [104] at a connection [112] having a convex bend with a radius $R_1$ and a concave bend with a radius $R_2$. As discussed previously, container [100] defines a container central axis (not shown) that is substantially parallel to outer sidewall [104] and passes through the geometric center of container [100]. Shoulder portion [110] forms a shoulder angle $\alpha$, with a plane perpendicular to the container central axis. An exemplary range of values of shoulder angle $\alpha$ for producing suitable containers, is 30 to 75 degrees. As shoulder angle $\alpha$ approaches 75 degrees, the ability of container [100] to withstand a vertical top load is relatively maximal. Such an angle would also yield relatively minimal container [100] side impact resistance, and would minimize the height of outer sidewall [104], resulting in a relatively shorter label panel area for applying one or more labels to container [100]. As shoulder angle $\alpha$ approaches 30 degrees, the ability of container [100] to withstand a vertical top load is relatively minimal. Such an angle would also yield relatively maximal container [100] side impact resistance, and would maximize the height of outer sidewall [104], resulting in a relatively longer label panel area for applying one or more labels to container [100].

As shoulder angle $\alpha$ approaches 50 degrees, a balance is struck between maximizing vertical top load strength and maintaining acceptable hoop strength of the container. As an example, sufficient hoop strength may be desired in order for container [100] to maintain its cross-sectional shape while a bulk product is being poured or otherwise emptied from container [100]. At a selected shoulder angle $\alpha$ of 50 degrees a desirable container configuration may be achieved, such that the top load strength of the container is maximized while maintaining desired hoop strength. In this configuration the variable top load strength of shoulder portion [110] as a function of shoulder angle $\alpha$, is balanced or optimized with respect to the constant top load strength of the heel portion and the variable hoop strength of outer sidewall [104]. This balancing or optimization maximizes the top load container [100] is able to support while maintaining overall structural integrity. For example, as a vertical top load is applied to container [100], the heel portion of solid bottom end [102] may roll or buckle before shoulder portion [110] inverts or collapses, and before outer sidewall [104] buckles. In this configuration, the top loads at which shoulder portion [110] would collapse and outer sidewall [104] would buckle are each equal to or greater than that of the heel portion.

At a shoulder angle $\alpha$ of 40 degrees, the variable top load strength of shoulder portion [110] is relatively minimal, and the variable hoop strength of outer sidewall [104] is relatively maximal. Accordingly, as a top load is applied to container [100], shoulder portion [110] may invert or collapse before the heel portion would roll or buckle, and before outer sidewall [104] would buckle. At a shoulder angle $\alpha$ of 60 degrees, the variable top load strength of shoulder portion [110] is relatively maximal, and the variable hoop strength of outer sidewall [104] is relatively minimal. Accordingly, as a top load is applied to container [100], the heel portion may roll or buckle before outer sidewall [104] would buckle, and before shoulder portion [110] would invert or collapse. While these $\alpha$ values may result in containers that have acceptable top load strength, they may be less desirable than a selected shoulder angle $\alpha$ of 50 degrees, which adjusts or balances the strength of the shoulder portion in proportion to the strength of the heel portion and the strength of the sidewall to maximize overall top load strength of the container.

Figure 10:
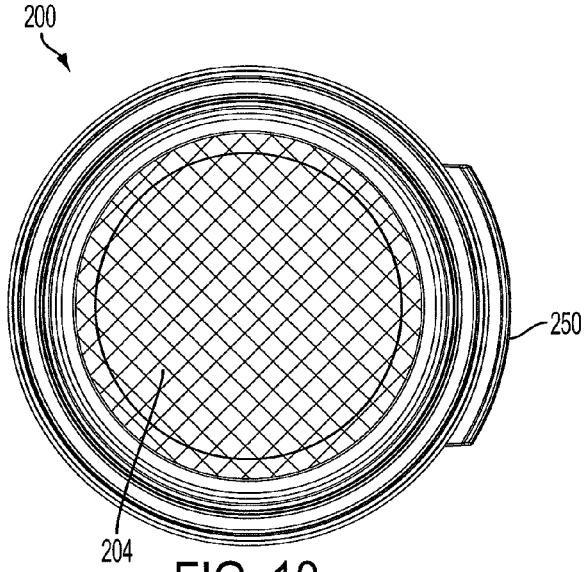
FIG. 10 is a bottom view of a closure according to various embodiments of the present invention.

FIG. 10 shows a bottom view of a closure [200] according to various embodiments. Closure [200] can be any suitable size, shape, and configuration. For example, closure [200] may be substantially circular and have a substantially planar center region. In various embodiments, closure [200] can be configured to be secured to container [100], over open end [108]. Additionally, closure [200] can comprise any suitable material. For example, closure [200] can comprise one or more plastics or combinations thereof, the plastics including, but not limited to, polyethylene terephthalate (PET), low density polyethylene (LDPE), high density polyethylene (HDPE), and nylons, as well as other polyesters, polyolefins, and polycarboxyamides having suitable properties for the intended application. Moreover, closure [200] can be made by any suitable process or method, including, but not limited to, blow molding, injection molding, extrusion blow molding; etc. U.S. Pat. No. 4,933,133 provides an example of a method of manufacture.

Figure 11:
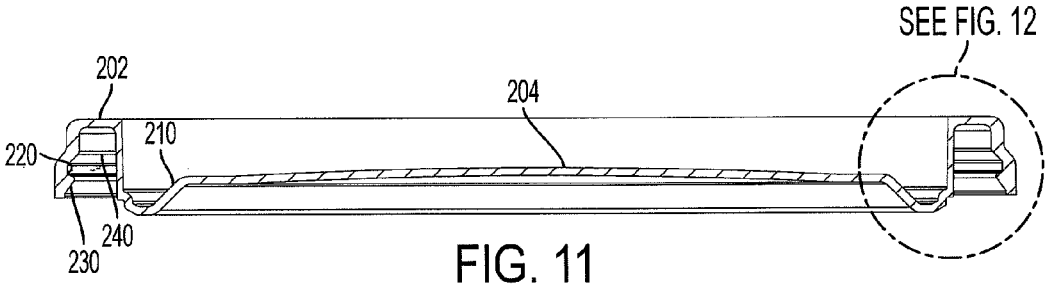
FIG. 11 is a cross-sectional side view of a closure according to various embodiments of the present invention.
Figure 12:
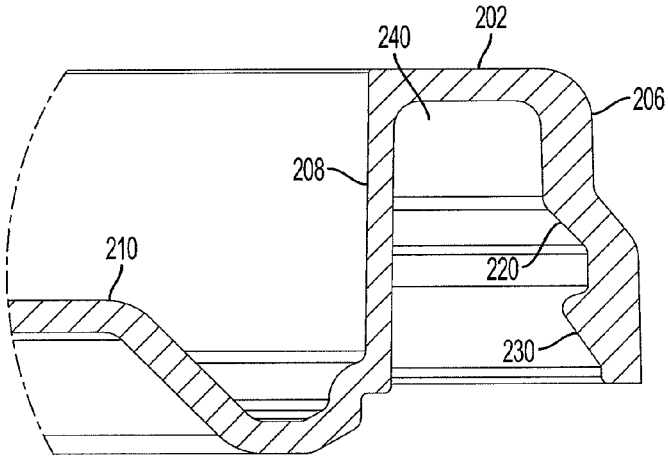
FIG. 12 is a fragmentary cross-sectional view depicting an enlarged portion of an area shown in FIG. 11.

FIG. 11 shows a cross-sectional view of closure [200]. As shown in FIG. 11, closure [200] may include a sealing portion [202], a spring portion [210] that extends inward from sealing portion [202], and a planar center area [204] configured in the center of closure [200] and extending inward from spring portion [210]. As can be seen from FIG. 12, sealing portion [202] can include an outer portion [206] and an inner portion [208] that form a first receptacle [240]. In various embodiments, outer portion [206] has a diameter greater than the diameter of neck portion [106], and inner portion [208] has a diameter less than the diameter of neck portion [106]. Additionally, in various embodiments, sealing portion [202] can include one or more recessed portions [220, 230]. The one or more recessed portions [220, 230] can be any suitable size and configuration. In various embodiments, the one or more recessed portions [220, 230] and the one or more sealing ridges [120, 130] of container [100] may be configured to interconnect to create a seal. For example, one or more recessed portions [220, 230] may include thread receptacles that are complementary to one or more sealing ridges [120, 130] (configured as a thread) of neck portion [106], which can allow for closure [200] to be threaded onto container [100].

Spring portion [210] can be formed in any suitable configuration. In various embodiments, spring portion [210] can surround planar center area [204]. Additionally, spring portion [210] may be an annular formation that bends in one direction out of the plane defined by the center planar area [204] and then bends back.

Figure 13:
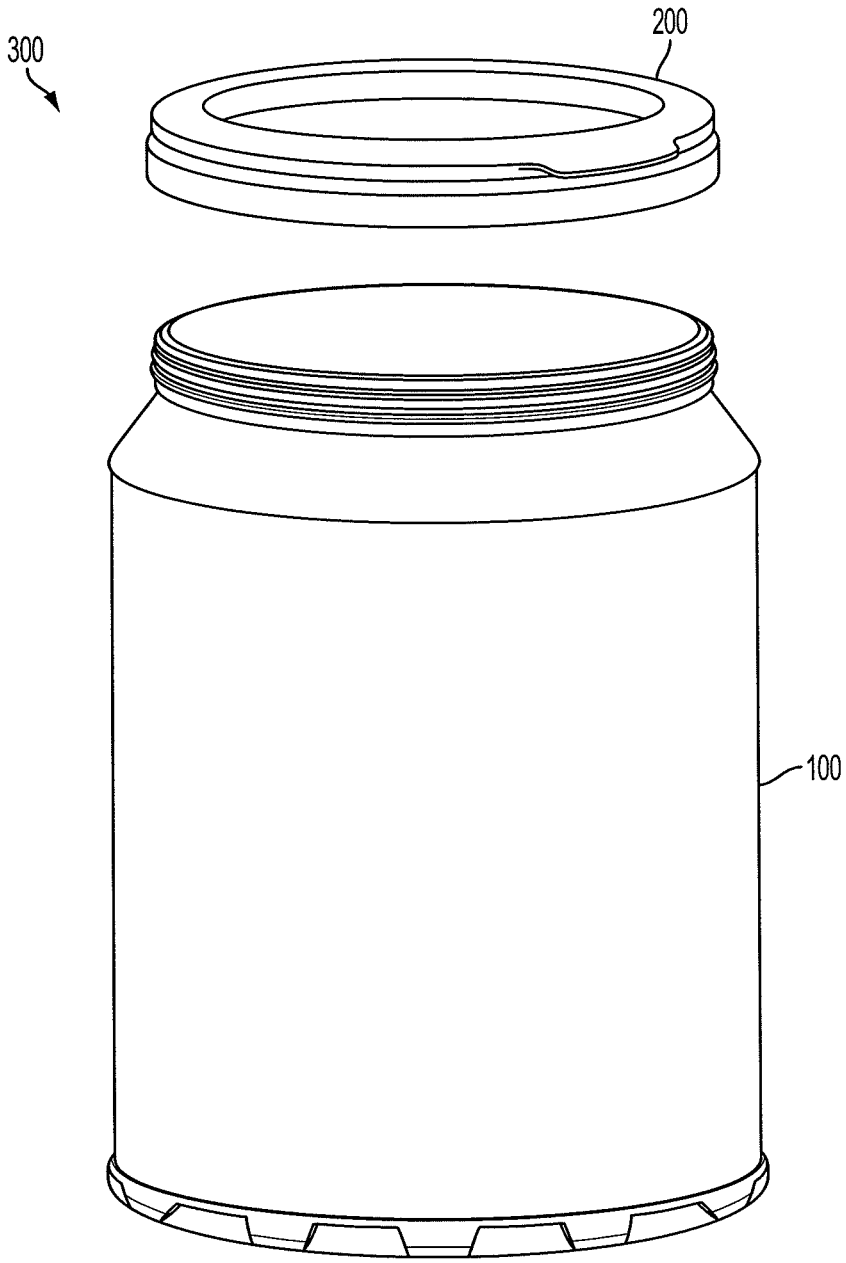
FIG. 13 is a front perspective view of a container and closure combination with the closure detached from the container, according to various embodiments of the present invention.
Figure 14:
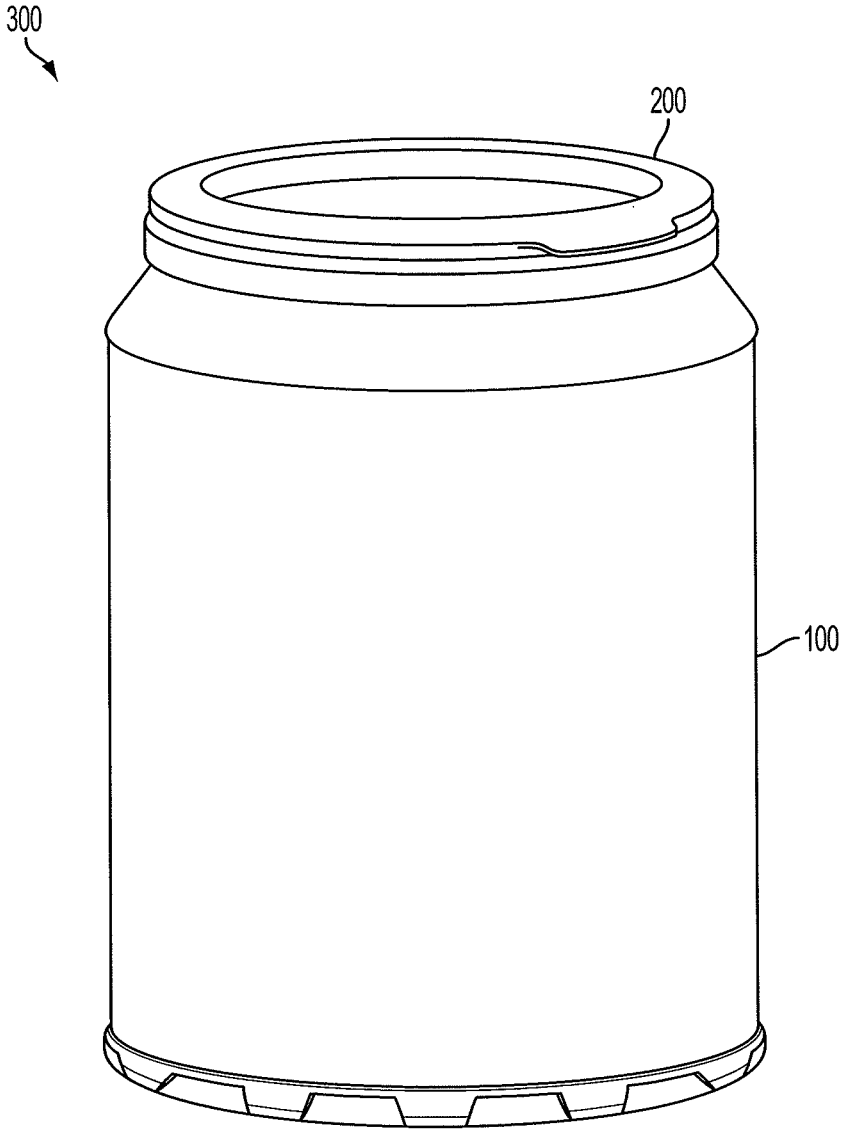
FIG. 14 is a front perspective view of a container and closure combination with the closure secured to the container, according to various embodiments of the present invention.

FIGS. 13 and 14 are front perspective views of a container and closure combination [300] according to various embodiments. FIG. 13 shows closure [200] being unsecured to container [100]. FIG. 14 shows closure [200] being secured to container [100]. Both FIGS. 13 and 14 show that closure [100] can be configured with a tab portion [250]. Tab portion [250] can be any suitable size and shape, and may be configured at any suitable position on closure [200]. Moreover, tab portion [250] may be of any suitable configuration such that a force can be applied thereto to allow removal of closure [200] from container [100]. For example, tab portion [250] may allow a pressure to be applied thereto to remove closure [200] from container [100]. In various embodiments, the pressure may be an upward pressure to tab portion [250] to remove closure [200] from container [100]. As another example, if the container and closure are secured together by threads and thread receptacles, a force may be applied to tab portion [250] from a side of tab portion [250] to allow closure [200] to be "unscrewed" from container [100].

Figure 15:
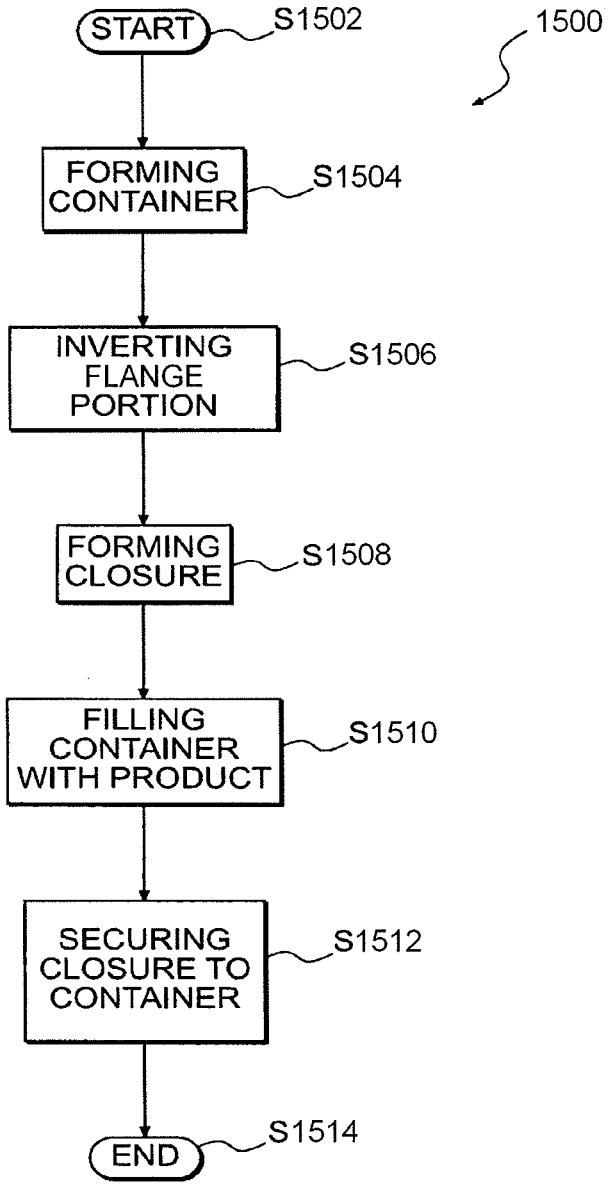
FIG. 15 is a flow chart of a method for forming a container and closure according to various embodiments.

FIG. 15 is a flow chart of a method [1500] for forming a container and closure according to various embodiments. Method [1500] begins at S1502 and may proceed to S1504, where container [100] is formed. As discussed above, container [100] can be any suitable size and/or shape and can be made from any suitable material. In various embodiments, container [100] can be made from plastic. At S1504, container [100] can be formed by any suitable method or process, including, but not limited to, blow molding, injection molding, and extrusion blow molding. In various embodiments, container [100] can be formed by forcing a gas into the interior of the container. The gas may be any suitable gas, including, but not limited to, air, nitrogen, etc. The gas can be forced into the interior of container [100] by any suitable means and at any suitable force. The method may proceed from S1504 to S1506. At S1506, a flange portion located at open end [108] can be inverted. The flange portion can be inverted by any suitable means and in any suitable number of steps or movements. For example, the flange portion can be forced downward, by any suitable means, toward the interior of container [100]. Alternatively, the flange portion can be held in place by any suitable means and container [100] pushed toward the flange portion, using any suitable means, so that the flange portion is inverted. Alternatively, S1506 can be deferred until after the container has been filled at S1510, and the flange portion may be inverted by the same force that is used to secure closure [200] to container [100] at S1512.

After S1506, the method may proceed to S1508, wherein closure [200] is formed. Alternatively, closure [200] can be formed before container [100] is formed or simultaneously with container [100]. As discussed above, closure [200] can be formed by any suitable process and can be configured to be secured to open end [108] of container [100].

After S1508, the method may proceed to S1510 where container [100] is filled with a product by any suitable means. Container can be filled with any suitable product, including, but not limited to, paint, chemicals, food, etc. In various embodiments, the product can be filled "hot" (above room temperature), "cold" (below room temperature), or at room temperature. For example, container [100] can be filled with paint, wherein the paint can be at a temperature of, for example, about 100 degrees Fahrenheit to about 110 degrees Fahrenheit.

S1510, the method may proceed to S1512 where closure [200] is secured over the open end [108] of container [100]. The method may then proceed to S1514 where the method ends.

Although FIG. 15 shows a step of filling the container with a product preceding a step of securing a closure to a container over the open end of the container, the closure may be secured to the container, and subsequently removed, before filling the container with a product. For example, the container and closure may be formed and secured together without filling the container with a product. The container may then be sent to a facility where the closure is removed, the container is filled with a product, and the closure is re-secured to the container over the open end of the container.

It is, therefore, apparent that there is provided in accordance with the present invention, a structure, system and method for producing a plastic container and closure combination. While this invention has been described in conjunction with a number of embodiments, it is evident that many alternatives, modifications and variations would be or are apparent to those of ordinary skill in the applicable arts. Accordingly, applicants intend to embrace all such alternatives, modifications, equivalents and variations that are within the spirit and scope of this invention.

What is claimed is:

1. A plastic container and closure combination comprising:
a container comprising:
a solid bottom end;
an outer sidewall extending from the solid bottom end;
a shoulder portion extending from the outer sidewall; and
a neck portion extending from the shoulder portion to create an open end of the container, the neck portion having a diameter less than a diameter of the outer sidewall; and
a closure comprising:
a sealing portion including an outer portion and an inner portion, the sealing portion defining a perimeter of the closure; and
a flexible planar center area in a center of the closure;
wherein the solid bottom end includes a circumferential heel portion having a plurality of radially asymmetrical projections and recesses disposed on an outer periphery of the heel portion, each radially asymmetrical projection having a pair of tapered side surfaces extending from a bearing surface, each projection having a corresponding radially asymmetrical projection aligned along a chord, and wherein for each projection, a side surface of the pair of tapered side surfaces is aligned along the chord with a side surface of the pair of tapered side surfaces of the corresponding radially asymmetrical projection; and;
wherein the container defines a container central axis, and the shoulder portion forms a shoulder angle with a plane perpendicular to the container central axis; and wherein the shoulder angle is in the range of 30 to 75 degrees.

2. The container and closure of claim 1, wherein the solid bottom end includes at least one support surface for supporting the container and closure on a horizontal surface, and wherein the plurality of radially asymmetrical projections and recesses are disposed radially outwardly from the support surface.

3. The container and closure of claim 1, wherein the shoulder angle is 50 degrees.

4. The container and closure of claim 1, wherein the closure further comprises a tab portion formed thereon, the tab portion being configured to allow a force to be applied thereto to remove the closure from the container.

5. A method of making a plastic container and closure combination for withstanding axial loading in stacking and closure operations, the method comprising:

forming the container by forcing a gas into the container via an aperture in the container, the formed container having:

a solid bottom end;

an outer sidewall extending from the solid bottom end;

a shoulder portion extending from the outer sidewall; and a neck portion extending from the shoulder portion to create an open end of the container, the neck portion having a diameter less than a diameter of the outer sidewall; and forming the closure, the closure having:

a sealing portion including an outer portion and an inner portion, the sealing portion defining a perimeter of the closure; and a flexible planar center area in a center of the closure;

wherein the solid bottom end includes a circumferential heel portion having a plurality of radially asymmetrical projections and recesses disposed on an outer periphery of the heel portion, each radially asymmetrical projection having a pair of tapered side surfaces extending from a bearing surface, each projection having a corresponding radially asymmetrical projection aligned along a chord, and wherein for each projection, a side surface of the pair of tapered side surfaces is aligned along the chord with a side surface of the pair of tapered side surfaces of the corresponding radially asymmetrical projection; and wherein the container defines a container central axis, and the shoulder portion forms a shoulder angle with a plane perpendicular to the container central axis; and wherein the shoulder angle is in the range of 30 to 75 degrees.

6. The method of claim 5, further comprising:

filling the container with a bulk material; and securing the closure to the filled container, over the open end of the container.

7. The method of claim 6, further comprising:

providing a plurality container and closure combinations, the container and closure combinations being similarly formed, filled and secured;

stacking the plurality of container and closure combinations to form an array of container and closure combinations, the array having at least two layers of stacked container and closure combinations; and securing the array of stacked container and closure combinations to one or more pallets.

8. The method of claim 6, wherein the bulk material is paint.

9. The method of claim 5, the plurality of projections and recesses being further configured to facilitate removal of the container from a mold in a blow molding operation.

10. The container and closure of claim 1, wherein the plurality of radially asymmetrical projections and recesses form a plurality of concentric load bearing circles.

11. The container and closure of claim 10, wherein the plurality of concentric load bearing circles have unequal diameters.

12. The container and closure of claim 1, wherein the plurality of radially asymmetrical projections are of different sizes circumferentially.

13. The container and closure of claim 1, wherein the outer portion has a diameter greater than the diameter of the neck portion of the container and the inner portion has a diameter smaller than the diameter of the neck portion of the container.

14. The container and closure of claim 1, further comprising a spring portion extending inward from the sealing portion, the flexible planar center area extending inward from the spring portion.

* * * * *